United States Patent [19]

Alznauer

[11] Patent Number: 5,035,569

[45] Date of Patent: Jul. 30, 1991

[54] METHOD AND APPARATUS FOR POSITIONING A CAN BODY

[75] Inventor: Kurt Alznauer, Lauchringen, Fed. Rep. of Germany

[73] Assignee: Elpatronic AG, Zug, Switzerland

[21] Appl. No.: 518,733

[22] Filed: May 2, 1990

[30] Foreign Application Priority Data

May 16, 1989 [CH] Switzerland ..... 01814/89

[51] Int. Cl.[5] ..... B21D 51/26; B21D 43/00

[52] U.S. Cl. ..... 414/757; 72/419; 413/69; 413/73; 413/75; 413/76

[58] Field of Search ..... 72/419, 420; 413/1, 413/54, 73-78, 69; 414/757; 198/394

[56] References Cited

U.S. PATENT DOCUMENTS

| | | | |
|---|---|---|---|
| 1,608,119 | 11/1926 | Perchard | 414/757 |
| 2,734,619 | 2/1956 | Labombarde | 198/394 |
| 2,843,253 | 7/1958 | Peterson et al. | 198/394 |
| 3,306,473 | 2/1967 | McCoy | 414/757 |
| 3,690,487 | 9/1972 | Evans et al. | 198/394 |
| 4,271,777 | 6/1981 | Collins | 413/76 |
| 4,712,960 | 12/1987 | Opprecht et al. | 413/54 |
| 4,901,557 | 2/1990 | Schmidt | 413/69 |
| 4,915,562 | 4/1990 | Opprecht et al. | 413/69 |

FOREIGN PATENT DOCUMENTS

| | | | |
|---|---|---|---|
| 3725186 | 1/1989 | Fed. Rep. of Germany | 72/393 |

OTHER PUBLICATIONS

"Formdose-Attraktivitat" by Jurgen Brauer, pub. CH Journal Soudronic News, 4th year, No. 7, Jun. 1988, p. 10.

U.K. Patent Application, pub. Mar. 1987, inventor: Kenneth Rouse.

*Primary Examiner*—Robert L. Spruill

*Attorney, Agent, or Firm*—McCormick, Paulding & Huber

[57] ABSTRACT

An apparatus is described for positioning a can body in the form of a longitudinal seam welded cylinder which is provided with a tongue or the like projection at a predetermined point of its outer circuference, and which is to be further processed, for example shaped. The can body is received in a device in a spatially fixed manner and is rotated about its longitudinal axis. The rotational movement is stopped by a stop (48) or like sensor or obstacle in the path of the tongue, the position of the stop being so selected that the longitudinal seam of the body is then in a precisely defined position. The seam is thus detected in a simple manner by means of a tongue. It is thereby possible to ensure that when a circular cylindrical can body is, for example, further shaped into a parallelepiped body, the longitudinal seam is precisely in the middle of a narrow side of the parallelepiped body.

20 Claims, 3 Drawing Sheets

METHOD AND APPARATUS FOR POSITIONING A CAN BODY

Figure 1:
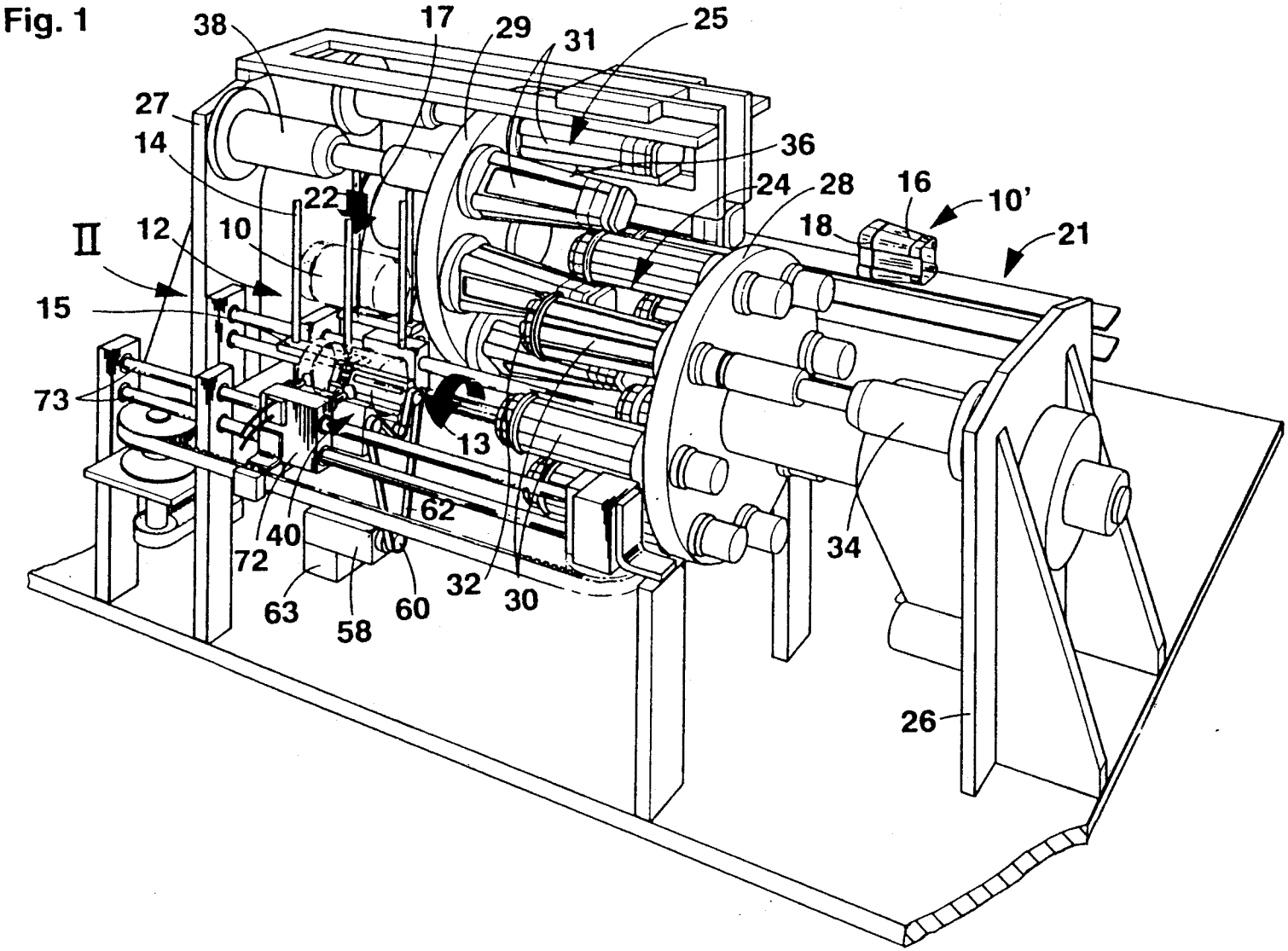

The invention relates to a method of positioning a can body which is produced by rolling a plane sheet-metal blank into a cylinder and longitudinal seam welding thereof, during which it is provided with a tongue or the like projection at a predetermined place on its outer circumference and is then further processed.

In addition, the invention relates to an apparatus for positioning a can body of the aforesaid kind.

Such a can body can be torn open by means of the tongue in that this is gripped by a key and rolled up. For this purpose, the can body further has a pair of circumferential scorings which extend round the can body transversely to the longitudinal axis thereof and define a tear strip laterally. There are two known possibilities for fitting the tongue to the can body.

The first possibility (DE-PS 1 017 042) lies in punching out the tongue together with the sheet-metal blank which is plane in the initial state, in one piece, in which case a starting scoring connecting the circumferential scorings to one another is also stamped in the sheet-metal blank in the region of one of its two longitudinal edges, simultaneously with the circumferential scorings. Before welding together its two longitudinal edges, the sheet-metal blank is rolled into a cylinder so that the two longitudinal edges overlap one another. After the longitudinal seam welding, a complete can is formed from such a can body in which the two ends of the can body are closed with a cover and a bottom respectively, by flanging. The key which is placed on the tongue to tear the can open has a slit to engage the tongue and is rolled on the nearer flange.

The second possibility (CH-PS 669 365) lies in welding the tongue, as a separate sheet-metal part, onto the outer circumference of the can body in the region of the tear strip, immediately on the longitudinal seam, or with some spacing from this, only after the longitudinal seam welding.

A known modification of that second possibility lies in welding the tongue onto the tear strip of the plane sheet-metal blank and only then rolling the sheet-metal blank into a cylinder and welding the longitudinal seam. This modification is described in DE-PS 35 15 812 which also shows very clearly in FIGS. *2a–2d* various forms of embodiment of the tongue before it is welded on.

A welding machine such as is known, for example, from DE-PS 35 13 703, originating from the Applicants, or an apparatus for the spot-welding of sheet-metal parts, particularly for welding tongues onto tear-open can members of tin plate such as is likewise known from DE-PS 35 15 833 originating from the Applicants, is suitable for welding on the tongues.

If such longitudinally seam welded can bodies provided with a tongue have to be further processed, the problem always arises that they have to have a very specific position in relation to the device used for the further processing, for example in order that lugs for securing a handle may be able to be fitted at places provided for them which have been reserved during the printing of the sheet-metal blank, of, if the circular cylindrical can body is to be further formed into another cross-sectional shape, in order that the longitudinal seam may come precisely in the middle of e.g. a narrow side of the finished can body. The latter is particularly difficult because, from the station in which they are rolled into a cylinder and longitudinally seam welded, on their way to the further processing device on which their interiors are coated with lacquer below the longitudinal seam and the tongue, the can bodies have to cover a distance of more than 30 meters, after which they are further processed, for example in an apparatus for producing frusto-pyramidal can bodies, such as is known from U.S. Pat. No. 4,901,557 likewise originating from the Applicants. In this known apparatus, the circular cylindrical can bodies are widened in a tapered oval over their whole length in a first expanding operation. Then the bodies are formed into the frustum of a pyramid in a second expanding operation, as a result of which the body is given a shape suitable for a corned beef can. An apparatus of this kind is used on high-capacity production lines which produce between 150 and 300 can bodies per minute. It is obvious that in this case it involves great difficulties and is practically impossible to keep the can bodies so positioned on the conveying path that the longitudinal seam comes precisely in the middle of the narrow side of the finished can body in the further shaping apparatus. This position of the longitudinal seam is important on the one hand in order that the circular cylindrical can body may be formed into a frustum of a pyramid and on the other hand in order that the tongue may be at a position on the finished can body in which it is not visually distracting, in which it can easily be introduced by its free end into the slit in the opening key and in which its welded-on end is in a position which allows the longitudinal seam, in the region of which the circumferential scorings are interrupted, to be torn through reliably nevertheless, during the rolling up of the tear strip, without converging crack lines forming. The upper photograph in the article "FormdoseAttraktivität" by Jürgen Brauer in the CH journal Soudronic news, 4th year, No. 7, June 1988, page 10 shows a clear example of the optimum position of the longitudinal seam and of the tongue.

It is the object of the invention to provide a method and a apparatus of the kind mentioned at the beginning, by means of which a can body can be so positioned that during the further processing of the can body, its longitudinal seam has a precisely defined position.

In order to solve this problem, a method of the kind mentioned at the beginning is characterised according to the invention in that, before the further processing, the can body is turned about its longitudinal axis until the rotation is stopped by a stop or the like sensor or obstacle in the path of the tongue, and an apparatus of the kind mentioned at the beginning is characterised according to the invention by a body-receiving device in which the can body can be received in a spatially fixed manner and can be set in rotational motion about its longitudinal axis, and by a stop or the like sensor or obstacle in the path of the tongue to stop the rotational motion.

Thus the invention is based on the basic idea of using the tongue provided at the outer circumference of each can body to position the can body so as to bring its longitudinal seam into a defined position for its further processing. This is easily possible because, regardless of in which of the ways outlined at the beginning the can body has been provided with the tongue, the latter always has a defined or ascertainable spacing from the longitudinal seam, which is accurate to 1/10th mm. The defined position of the longitudinal seam can also be adhered to precisely, according to the invention, because the can body need only be positioned immediately before its further processing. The stop may be arranged for adjustment in the circumferential direction of the can body in order to be able to adapt its position in case the said spacing between longitudinal seam and tongue should vary. In the simplest form of realization of the invention, the tongue simply moves against a fixed mechanical stop as a result of which the rotational movement of the can body about its longitudinal axis is stopped because, during its rotation, the can body is spatially fixed, that is to say it cannot move out of the way on contact between tongue and stop. Thus with the detection of the tongue by the stop, the actual detection of the longitudinal seam of the can body aimed at according to the invention is effected.

Advantageous developments of the invention form the subject of the sub-claims.

In one development of the invention which is of particular advantage in the high-capacity plant mentioned at the beginning, the rotational movement of the can body about its longitudinal axis is slowed down if on its way to the stop, the tongue passes a sensor at a position situated before the stop, which sensor initiates a switching operation whereby a speed reducing device is actuated. The can body can then continue to rotate at a slower speed until it reaches the stop or the speed of rotation of the can body can be progressively reduced so that it is almost zero when the tongue reaches the stop. One way or the other, assurance is provided that the tongue does not rebound from the stop if use is made of mechanical stop and the can body has to be positioned at the highest possible speed.

In a further development of the invention wherein the body-receiving device comprises magnetic rollers for rotating and simultaneously holding down the can body, the above-mentioned development offers the further advantage that the speed of rotation of the can body can be retarded or reduced to zero when the tongue has reached the stop in order to avoid unnecessary frictional losses between the magnetic rollers, which would otherwise continue to rotate, and the stopped can body. Coupled with the operation in which the stopped can body is then transferred to the further processing device, the rotational drive of the body-receiving device can be switched on again.

In a further development of the invention, the transfer to the further processing device is effected in the direction of the longitudinal axis or parallel to the longitudinal axis of the positioned can body while maintaining the rotational position thereof which has been achieved. Two transfer conveyors are preferably provided for this, which are appropriately guided and can be reciprocated. These transfer conveyors have body entrainment means which can be brought towards one another to within a mutual spacing which is shorter than the diameter of the can body. Thus when the body entrainment means receive the can body between them, the latter is shaped into an oval cylinder by pressure exerted diametrically on its outer circumference. This has the advantage on the one hand that the outer circumference of the can body is moved away from the peripheral surfaces of the magnetic rollers and the attractive force exerted on the can body by the magnetic rollers is reduced as a result, and on the other hand that the transfer can be effected to a tool to which the can body must in any case be supplied in oval cylindrical shape. Thus the transfer conveyors simultaneously form the ovalizing device otherwise necessary.

Although the rollers are preferably constructed in the form of magnetic rollers as a device for holding down the can body in the body-receiving device, that is to say to ensure the spatially fixed position of the can body in the body-receiving device, nevertheless it is easily possible to use another holding-down device in connection with non-magnetic rollers, for example further rolls or rollers which can be adjusted against the outer circumference of the can body after this has been supplied to the body-receiving device. In the latter case, the peripheral surfaces of the driven roller(s) would be provided with a high coefficient of friction so that the rotational motion of the can body is produced without slip as far as possible.

In yet another development of the invention, the stop may be the actuating member of a microswitch or the like so that although a mechanical contact is established between the tongue and this obstacle, nevertheless the stopping of the rotary drive device for the can body is then effected by electrical means. Furthermore, the actuating member may simply be a sensor comprising a beam of light, a magnetic field, an electrical field or the like so that when the tongue passes through, a contactless actuation of a switching device is effected. The sensor which may be arranged on the body-receiving device along the path of the tongue at a point situated before the stop can also easily be constructed in the above-mentioned manner.

In yet another development of the invention, the can bodies are simply supplied to the body-receiving device via a vertical body feed shaft, which they enter at the upper end and then move down to the body-receiving device under their own weight.

A body separator is preferably provided in the body feed shaft at a point immediately above the can body which has been received in the body-receiving device. The body separator preferably has two jaws which are movable towards and away from one another transversely to the feed shaft to allow one can body at a time into the bodyreceiving device and then to keep the weight of the other can bodies above it away from this one body.

One example of embodiment of the invention is described in more detail below with reference to the drawings.

Figure 2:
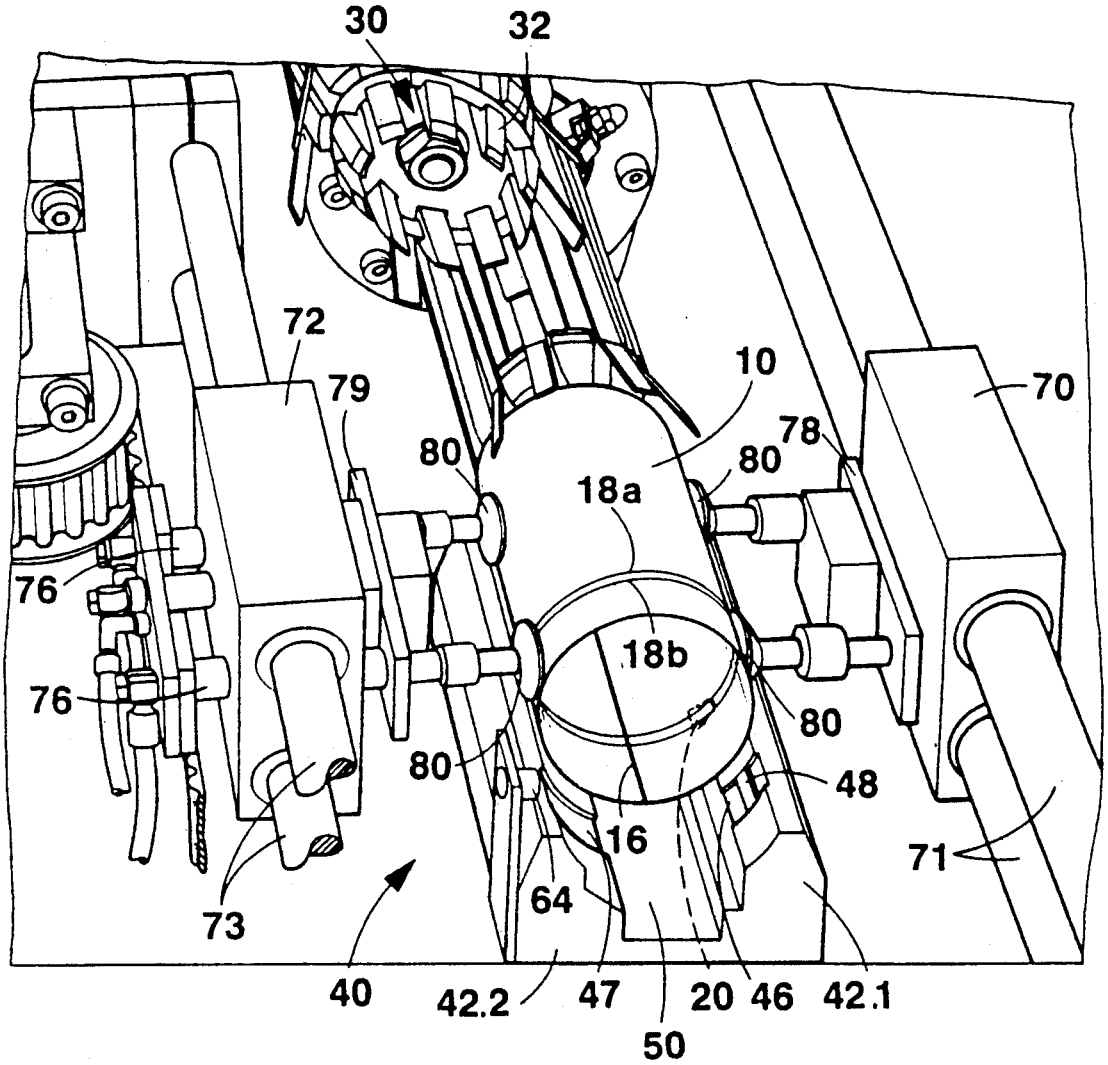
Figure 3:
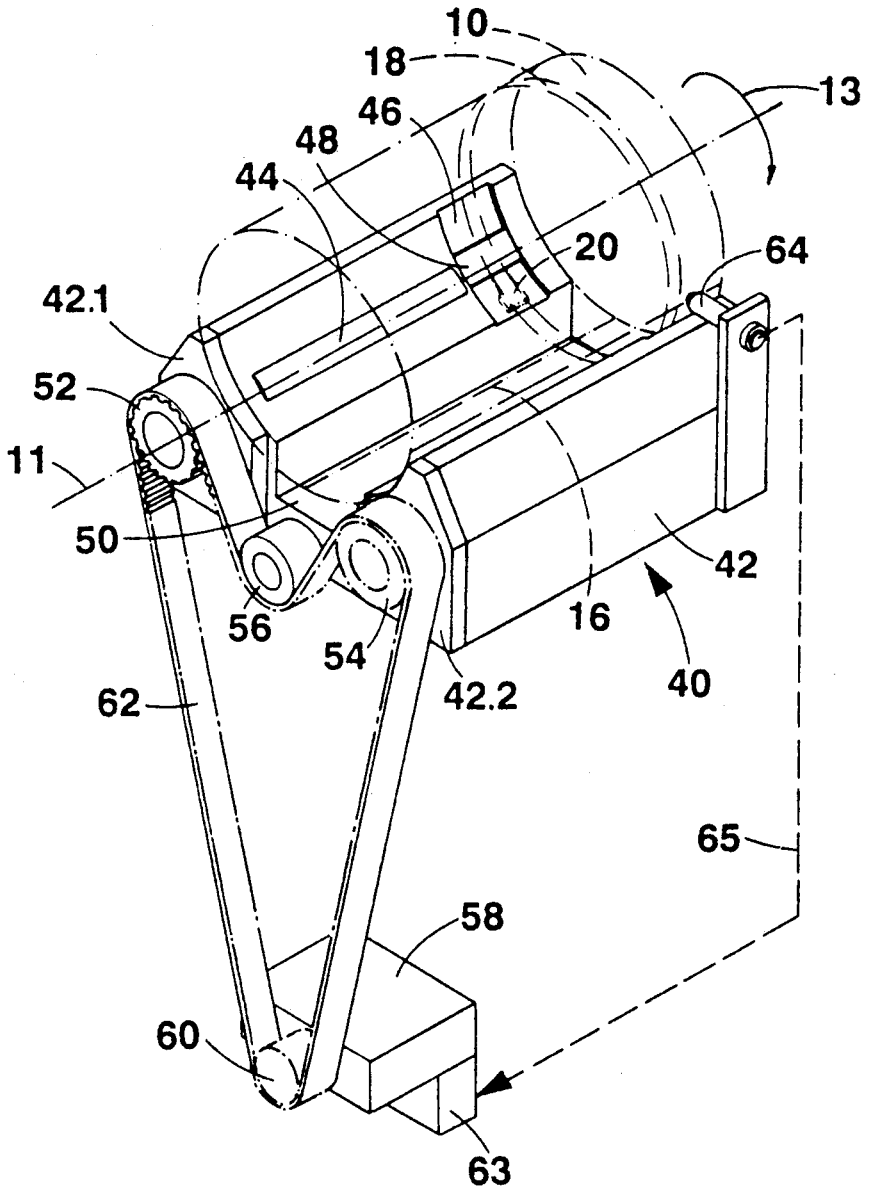

FIG. 1 shows a machine for producing frustopyramidal can bodies, which machine is provided with the apparatus according to the invention, FIG. 2 shows a view in the direction of an arrow II in FIG. 1, wherein transfer conveyors have just removed a positioned can body from a body receiving device, and FIG. 3 shows, as a detail, the body receiving device with its rotary drive device.

FIG. 1 shows a general view of a machine which shapes circular cylindrical can bodies 10 into frustopyramidal bodies 10' for cans for corned beef or the like. The machine is provided, at its entry, with a body-positioning apparatus designated as a whole by 12. Before the body-positioning apparatus is described in detail, the construction of the machine will be explained to the extent necessary for an understanding of the invention. A detailed description of the machine will be found in U.S. Pat. No. 4,901,557 already mentioned at the beginning. The machine explained here differs from the known machine in that its body feeding and ovalizing device has been replaced by the body-positioning apparatus 12.

The circular cylindrical can bodies 10 are supplied to the machine shown in FIG. 1 via a feed shaft 14 indicated by four rods, from a body longitudinal seam welding machine, not illustrated. Each can body 10 has a longitudinal seam 16 and, in the vicinity of one of its ends, an annular tear strip 18 closed on itself. At the outer circumference of each can body 10, a tongue 20 is welded, as a separate sheet-metal part, onto the tear strip at a predetermined position. The tear strip 18 is defined by two circumferential scorings 18*a*,18*b* which have been impressed in the still plane sheet-metal blank as weakening lines. The machine shapes the can bodies 10 step by step, namely, starting from the circular cylindrical shape in which they are supplied to the machine in the direction of an arrow 22, first into an oval cylindrical shape, then into a tapered oval shape and then into the frusto-pyramidal body 10' which, on leaving the machine, has the shape which can be seen at the top right in FIG. 1. The frustum of a pyramid has rounded longitudinal edges. Two longitudinal recesses in its broad side faces are of no interest here. The longitudinal seam 16 should be precisely in the middle of one of the two narrow side faces of the finished body 10'. The body-positioning apparatus 12 described in more detail below, is provided to ensure this. In the state shown in FIG. 1, the finished body 10' goes to the corned beef manufacturer who fills it and at the same time provides the two ends with a bottom and cover respectively.

From the body-positioning apparatus 12, the can body 10 is removed in the manner likewise described in more detail below, ovalized and transferred into a first shaping stage 24 of the machine. The first shaping stage 24 comprises a first rotary table 28 which is secured to an upright 26 and which is rotatable about a horizontal axis and to which eight parallel expanding mandrels 30 are secured with equal spacing. The rotary table 28 can be turned stepwise through 45° each time. Each expanding mandrel 30 comprises a ring of pivotable segmental bars 32 which can be expanded by means of an expanding cylinder 34 in such a manner that a can body 10 placed on them is widened out into a tapered oval shape, the greatest widening taking place at the end of the can body 10 which is adjacent to a second shaping stage 25.

The second shaping stage 25 comprises a second rotary table 29 which is secured to an upright 27 and which is likewise rotatable about a horizontal axis which is parallel to the axis of rotation of the first rotary table 28. Secured to the second rotary table 29, parallel to its axis of rotation, are eight expanding mandrels 31 equally spaced apart. The second rotary table 29 can be rotated cyclically in synchronism with the first rotary table 28, and after each rotational cycle, an expanding mandrel 31 is in alignment with an expanding mandrel 30. Each expanding mandrel 31 has four segmental bars 36, the outer radius of which corresponds to the rounding of the lateral edges of the frusto-pyramidal body 10'. The segmental bars 36 can be expanded by means of an expanding cylinder 38.

After each movement step of the two rotary tables 28,29, one of the expanding mandrels 30 is in alignment with the body positioning apparatus 12 in order to receive from this a can body 10 shaped into an oval cylinder. The widening out of the can body 10 into a tapered oval is effected at a position 45° from this. Finally, after the first rotary table 28 has turned through 180°, the expanding mandrel 30, which carries the can body 10 shaped into a tapered oval and additionally heated in the meantime; is situated axially opposite one of the expanding mandrels 31 which is fitted to the second rotary table 29 and to which the can body is now transferred in a manner not illustrated. On the next cycle of the second rotary table 29, this moves through 45° to a position where the expanding mandrel 31 shapes the can body 10 into the frustum of a pyramid. Finally, this expanding mandrel 31 reaches the exit from the machine where the frusto-pyramidal body 10' is removed and transferred to a longitudinal conveyor 21. Thus eight frusto-pyramidal can bodies 10 are produced in the course of one revolution of the rotary tables 28,29.

The body-positioning apparatus 12 comprises a body receiving device which is designated as a whole by 40 and is illustrated as a detail in FIG. 3. The body receiving device 40 is stationary and receives one can body 10 (indicated in chain lines in FIG. 3) at a time in a spatially fixed manner. In the body receiving device 40, the can body 10 can be set in rotation about its longitudinal axis 11, namely in the direction of an arrow 13 in the example of embodiment illustrated here.

The body-receiving device 40 comprises a block 42 on which two bearing blocks 42.1 and 42.2 are formed. The bearing blocks 42.1,42.2 are each hollow and each contains a roller 44 which is mounted for rotation in the bearing-block cavity. Each bearing block has an arcuate upper surface with an opening out of which its roller 44 projects somewhat. These projecting portions of the rollers 44 serve as a support for the can body 10 for the rotatable mounting thereof. In the arcuate upper surfaces, the block 42 is provided with arcuate grooves 46 and 47 respectively in the region of the path which the tongue 20 takes during the rotation of the can body 10 about the longitudinal axis 22. The arcuate grooves 46,47 are so deep that the tongue 20 can pass through them without hindrance. A mechanical stop 48 is provided in the groove 46 to stop the rotational movement of the can body 10 by positively engaging the tongue 20. The stop 48 is adjustable in the groove 46 in order that the longitudinal seam 16 of the can body 10 may be precisely over the middle of a channel 50 formed between the bearing blocks 42.1 and 42.2, when the tongue 20 is in contact with the stop 48.

The rollers 44 mounted for rotation in the bearing blocks 42.1 and 42.2 project beyond one end of the blocks. Pinions 52 and 54 respectively are each keyed onto one of these free ends. An adjustable tensioning pulley 56 is secured to the end face of the block 42 between the pinions 52,54 in the region of the channel 50. A motor 58 is secured to the machine frame as a rotary drive device, the output shaft of which carries a pinion 60 which drives the pinions 52 and 54 via a toothed belt 62 in the manner shown in FIG. 3, in order to set both rollers 44 in rotation. Associated with the motor 58 is a control device 63 by means of which the motor can be switched on and off, switched to a lower speed or be retarded in accordance with a specific braking pattern etc., for a purpose which will be explained below. In order that the can body 10 may retain its spatially fixed position on the body receiving device 40, a holding-down device is provided which has been realized in the example of embodiment described here in that the rollers 44 have been constructed in the form of magnetic rollers. For this purpose, a permanent magnet is accommodated in each of the rollers and pulls the can body 10, usually made of tin plate, against the peripheral surface of the roller. To provide a low-friction construction, the peripheral surfaces of the rollers are themselves hard-chromium plated in the example of embodiment illustrated.

Along the path of the tongue 20, a detector 64 is secured at a position in front of the stop 48 and is electrically connected to the speed reducing device 63 by a line 65 indicated by means of a broken line. The detector 64 is preferably an optical or optoelectronic sensor but it may be a question of a magnetic, capacitive or the like sensor which is in a position, when the tongue 20 goes past, to trigger a switching operation in the speed-reducing device 63, whereby the motor 58 is switched to a lower speed or is slowed in accordance with a specific braking pattern until the tongue 20 has reached the stop 48, whereupon the motor 58 can be stopped completely. The detector 64 could, as could likewise the stop 48, also consist simply of a spring-loaded actuating member of a microswitch or the like which, on actuation of its actuating member, triggers a switching operation slowing down or stopping the motor 58.

Disposed one at each side of the body receiving device 40, parallel to the longitudinal axis 11 of the can body 10 and each displaceable backwards and forwards on two parallel guide bars 71 and 73 respectively is a pair of transfer conveyors 70 and 72 respectively which are situated diametrically opposite one another in relation to the can body 10 present in the body-receiving device 40. Guided on each transfer conveyor 70,72 are transverse bars 76 which are displaceable transversely to the longitudinal axis 11 and carry yokes 78 and 79 respectively. Secured to the yokes 78,79 as body entrainment means are suction cups 80 which are connected to a suction pump not illustrated and can be laid against the can body 10 to be conveyed further in order to transfer this from the bodypositioning apparatus 12 to the expanding mandrel 30 situated opposite this. The oppositely situated suction cups 80 of the two transfer conveyors 70,72 are movable to within a mutual spacing less than the diameter of the can body 10, as a result of which the can body is converted out of its circular cylindrical shape into an oval cylindrical shape and at the same time is separated from the magnetic rollers 44. This procedure takes place when the tongue 20 has reached the stop 48 and, consequently, a switching operation has been triggered as a result of which the suction cups 80 are moved against the can body present in the body receiving device 40.

The body feed shaft 14 is provided with a body separator which comprises two jaws 15,17 which are movable, above the body receiving device 40, towards and away from one another, transversely to the feed shaft, by means of a pressure-fluid cylinder (not illustrated). The two jaws 15,17 are at a position somewhat above a can body 10 disposed in the body-receiving device 40 and normally project so far into the vertical feed shaft 14 that the body 10 following next rests on them so that the jaws carry the weight of all the other bodies and the can body disposed in the body receiving device 40 is thus relieved of this weight. When the body 10 present in the body-receiving device 40 has been positioned and conveyed further towards the right in FIG. 1, in the direction of the longitudinal axis 11, the body separator is actuated, that is to say the jaws 15,17 are withdrawn out of the feed shaft 14 until the next can body has slid into the body receiving device 40, and are then moved back into the feed shaft.

The method of positioning a can body 10, including the feed and further conveying of the body, therefore includes the following steps:

After the body separator has allowed a can body 10 to slide into the body receiving device 40 and has then again taken up the weight of the other bodies in the vertical feed shaft 14, the electric motor 58 is switched on so that both magnetic rollers 44 are set in rotation via the toothed belt 62. These rollers rotate the can body 10 about its longitudinal axis 11, in the direction of the arrow 13 until the tongue 20 strikes against the stop 48. In order to effect this impingement as far as possible without any rebound and to avoid unnecessary slipping movement between the rollers 44 and the outer circumference of the can body 10 after the impingement of the tongue 20 on the stop 48, the speed of the motor 58 is reduced, for example in accordance with a preset braking pattern, from the moment when the tongue 20 passes the detector 64. Once the tongue 20 has impinged on the stop 48, the can body 10 remains still. The body entrainment means in the form of the suction cups 80 are now moved against the body 10, during which it is formed into an oval cylindrical shape by the pressure exerted diametrically on its outer circumference and at the same time is separated from the rollers 44. Thereupon the transfer conveyors 70,72 are actuated which, while maintaining the rotational position achieved, convey the body 10 in the direction of its longitudinal axis 11 to the expanding mandrel 30 and push it onto this.

The method and the apparatus which have been described here can easily also be used for can bodies which, instead of the tongue 20 serving to tear the can open, have any projection beyond the outer circumference of the body and so can be engaged in the manner described by the stop 48 or the like sensor or obstacle. Such a projection may be a raised embossing or a welded-on sheet metal part with which the can body or the plane sheet-metal blank from which it is produced, is additionally provided in order that the apparatus described here may be used and the method described here carried out.

I claim:

1. A method of positioning a can body which is produced by rolling a plane sheet-metal blank into a cylinder, placing a tongue-like projection at a predetermined point on the blank so that the tongue-like projection appears on the outer circumferential of the rolled blank, then longitudinally seam welding the blank to form a can body and further processing the can body characterized by, after longitudinally seam welding and before further processing, rotating the can body about its longitudinal axis within a block having an arcuate groove in the path followed by the tongue-like projection on the rotating can body, detecting the rotational position of the can body by means of the rotational position of the tongue-like projection in the groove; and stopping the rotation of the can body in response to the detected rotational position with the tongue-like projection and the can body at a predetermined rotational position.

2. A method according to claim 20 characterized by the additional step of slowing down the rotational movement of the can body about its longitudinal axis when the tongue-like projection passes a point situated on the path.

3. A method according to claim 20 further characterized by supplying the can body to the further processing by conveying the can body further in the direction of its longitudinal axis or parallel thereto while maintaining the predetermined rotational position.

4. A method according to claim 3, further characterized by forming the can body into an oval cylindrical shape with the weld seam at a predetermined position in the oval by pressure exerted diametrically on its outer circumference during said further conveying.

5. An apparatus for positioning a can body which body consists of a longitudinal seam welded cylinder provided with a tongue-like projection at a predetermined point of its outer circumference and is to be further processed, characterized by a body-receiving device in the form of a block having an opening in which the can body is received in a spatially fixed manner for rotational movement, the block having an arcuate groove in the region of the path followed by the tongue-like projection during rotational movement of the can body within the block; means supporting the can body in the opening of the block for rotational movement about its longitudinal axis; driving means for rotating the can body within the block about the longitudinal can axis and a stop or like sensor or obstacle in the arcuate groove of the block and rotational path of the tongue-like projection to stop the rotational movement of the can body at a predetermined rotational position.

6. An apparatus according to claim 5, characterized in that the means for supporting includes at least two rollers rotatably mounted in the block as a support for the can body, and the drive means is connected for rotatably driving at least one of the rollers and the can body within the block.

7. An apparatus according to claim 6 further including a holding-down means for holding the can body on the rollers.

8. An apparatus to claim 7, characterized in that the rollers are constructed in the form of magnetic rollers to provide said holding-down means.

9. An apparatus according to claim 7, characterized in that the peripheral surface of each driven roller is of low-friction construction.

10. An apparatus according to claim 9, characterized in that the low-friction peripheral surface is hard-chromium plated.

11. An apparatus according to claim 5, characterized in that the stop is a mechanical stop to stop the rotational movement of the can body by positive engagement of the tongue-like projection.

12. An apparatus according to claim 5, characterized in that the stop is an actuating member to trigger a switching operation stopping the drive means from rotating the can body.

13. An apparatus according to claim 12, characterized in that the actuating member is a part of an optical, optoelectronic, magnetic, or capacitive switching device, which part is actuated by the tongue-like projection and extends into the arcuate groove in the path of the tongue-like projection.

14. An apparatus according to claim 5, characterized by a detector which is disposed along the path of the tongue at a point situated before the stop and is connected to a device for reducing the speed of the drive means.

15. An apparatus according to claim 14, characterized in that the detector is a mechanical, optical, optoelectronic, magnetic, or capacitive sensor which, when the tongue-like projection goes past, triggers a switching operation in the speed reducing device.

16. An apparatus according to claim 5, characterized by a pair of transfer conveyors which are disposed one at each side of the body-receiving device and are displaceable backwards and forwards parallel to the longitudinal axis of the can body, and comprise body entrainment means for engaging the can body

17. An apparatus according to claim 16, characterized in that the body entrainment means is moved to within a mutual spacing which is less than the diameter of the can body.

18. An apparatus according to claim 16, characterized in that the body-receiving device is arranged axially in alignment with a device for the further processing of the can body, the transfer conveyors are each displaceable backwards and forwards on two parallel guide bars, and the body entrainment means are suction cups connected to a suction pump.

19. An apparatus according to claim 5, characterized by a vertical can body feed shaft which is disposed above the body-receiving device and which is provided with a body separator.

20. An apparatus according to claim 19, characterized in that the body separator comprises two jaws which are movable, above the body-receiving device, towards and away from one another, transversely to the feed shaft.

* * * * *